US006394286B1

(12) United States Patent
Dueck

(10) Patent No.: US 6,394,286 B1
(45) Date of Patent: May 28, 2002

(54) AREA RUG HANGING DISPLAY

(76) Inventor: Raymond Dueck, Box 700, Arborg, Manitoba (CA), R0C 0A0

( * ) Notice: Subject to any disclaimer, the term of this patent is extended or adjusted under 35 U.S.C. 154(b) by 0 days.

(21) Appl. No.: 09/758,314

(22) Filed: Jan. 12, 2001

(51) Int. Cl.[7] ..... A47F 5/00

(52) U.S. Cl. ..... 211/48; 211/1.57; 211/96; 211/103; 211/169; 211/174

(58) Field of Search ..... 211/47, 48, 96, 211/102, 103, 1.51, 1.57, 207, 169, 174

(56) References Cited

U.S. PATENT DOCUMENTS

| | | | | | |
|---|---|---|---|---|---|
| 355,125 | A | * | 12/1886 | Bisel | |
| 509,349 | A | * | 11/1893 | Bisel | |
| 595,549 | A | * | 12/1897 | Roush et al. | |
| 920,962 | A | | 5/1909 | Kepke | |
| 1,006,834 | A | | 10/1911 | Edwards | |
| 1,068,050 | A | * | 7/1913 | Gardner et al. | |
| 1,099,345 | A | | 6/1914 | Dougherty | |
| 1,162,989 | A | | 12/1915 | Doran | |
| 1,745,713 | A | | 2/1930 | Reed | |
| 2,000,336 | A | | 5/1935 | Kerr | |
| 2,023,866 | A | | 12/1935 | Best | |
| 2,154,622 | A | * | 4/1939 | Jones | |
| 3,187,900 | A | | 6/1965 | Schneider | |
| 3,315,813 | A | * | 4/1967 | Schneider | |
| 3,330,418 | A | | 7/1967 | Schneider | |
| D218,917 | S | | 10/1970 | Trunsperger | |
| 3,603,461 | A | * | 9/1971 | Best | 211/47 |
| 4,634,010 | A | * | 1/1987 | Otema | 211/96 |
| 4,685,573 | A | | 8/1987 | Ovitz, III | |
| 5,292,011 | A | | 3/1994 | Kostigian | |

* cited by examiner

*Primary Examiner*—Robert W. Gibson, Jr.
(74) *Attorney, Agent, or Firm*—Adrian D. Battison; Michael R. Williams; Ryan W. Dupuis

(57) ABSTRACT

A display rack for displaying a plurality of rugs includes a plurality of generally upright elongate support posts connected side by side by a support frame with each post having mounted thereon for sliding movement therealong a respective one of a plurality of rug support assemblies. Each support post has a cable and winch inside the respective post for driving sliding movement of the respective rug support assembly between a lowered loading position and a raised display position with a motor mounted permanently on the post or on the mounting assembly and a manually operable switch for operating the motor. Each rug support assembly includes a front plate member in front of the post and a plurality of pivotal arms side by side across the plate member. A divider post is provided between each support post and the next upright at a position in front of the support posts so as to engage rug support arms to prevent side to side movement of the arms sufficient to cause interference therebetween.

17 Claims, 7 Drawing Sheets

AREA RUG HANGING DISPLAY

FIELD OF THE INVENTION

The present invention relates to an area rug hanging display which carries a plurality of rugs and allows a person to view an individual rug.

BACKGROUND OF THE INVENTION

In displaying area rugs and the like it is desirable to display all the rugs such that all the rugs can be view relatively easily without requiring much effort by a person. Generally rugs are either laid out on the ground, or hung on a wall so as to let people see the rugs. This method takes up a large amount of area, if there are a large amount of rugs being shown, and is cumbersome to a person if they would like to view an individual rug. Some examples of area rug displays are disclosed in U.S. Pat. No. D 218,917 (Trunsperger), U.S. Pat. No. 4,685,573 (Ovitz, III), U.S. Pat. No. 920,962 (Kepke), U.S. Pat. No. 2,000,336 (Kerr), U.S. Pat. No. 3.315,813 (Schneider) and U.S. Pat. No. 1,162,989 (Doran). The above US Patents do not allow a plurality of rugs to be stored or hung such that an individual rug can be viewed by a person.

Some examples of area rug hanging displays are also disclosed in U.S. Pat. No. 806,705 (O'Neal), U.S. Pat. No. 1,006.834 (Edwards), U.S. Pat. No. 1,099,345 (Dougherty), U.S. Pat. No. 1,162,989 (Doran), U.S. Pat. No. 1,745,713 (Reed), U.S. Pat. No. 2,000,336 (Kerr), U.S. Pat. No. 2,023,866 (Best), U.S. Pat. Nos. 3,187,900, 3,315,813, 3,330,418 (all of Schneider) and U.S. Pat. No. 5,292,011 (Kostigian).

SUMMARY OF THE INVENTION

It is one object of the present invention to provide an improved display rack for rugs.

According to one aspect of the invention there is provided a display rack for displaying a plurality of rugs comprising;

a plurality of generally upright elongate support posts;

a mounting assembly supporting the support posts arranged side by side in spaced parallel relationship;

each support post having mounted thereon for sliding movement therealong a respective one of a plurality of rug support assemblies;

each support post having a drive system for driving sliding movement of the respective mg support assembly between a lowered loading position and a raised display position;

each drive system including a pulley at an upper end of the support post and a cable wrapped over the pulley and arranged such that pulling of the cable acts to raise the support assembly on the post;

each drive system including a winch for pulling the cable;

and each drive system including a motor mounted permanently on the post or on the mounting assembly for the post for driving the winch and a manually operable switch for operating the motor.

This arrangement allows the rack to provide easy convenient use by the operator for raising and lowering the racks by operation of a simple switch.

Preferably the cable runs inside a hollow tube defining the post and wherein the winch is mounted across the post.

Preferably the motor is mounted on a housing at one side of the post.

Preferably the motor has a drive shaft parallel to the post and includes a right angle drive inside the housing for driving the winch within the post.

Preferably the pulley is mounted at a top of the post and bridges between a run inside the post and a run outside and in front of the post and extending to the support assembly.

Preferably each rug support assembly includes a front plate member in front of the post and a plurality of rack members each arranged to receive a respective rug, the rack members being mounted on the plate member for pivotal movement each about a respective vertical axis with the rack members arranged side by side across the plate member.

Preferably the plate member includes a rearwardly extending bracket carrying front and rear guide rollers for rolling along on a front and rear respectively of the post.

Preferably there is provided a divider post between each support post and the next and arranged to extend generally upright at a position in front of the support posts so as to engage rug support arms of the rug support assembly to prevent side to side movement of the arms sufficient to cause interference therebetween.

Preferably there is provided a top rail and a bottom rail interconnecting the posts and arranged to mount top and bottom ends respectively of the divider post thereon.

Preferably the divider posts each have top and bottom end portions extending rearwardly from the post to the respective rail.

According to a second aspect of the invention there is provided a display rack for displaying a plurality of rugs comprising;

a plurality of generally upright elongate support posts;

a mounting assembly supporting the support posts arranged side by side in spaced parallel relationship;

each support post having mounted thereon for sliding movement therealong a respective one of a plurality of rug support assemblies;

each support post having a drive system for driving sliding movement of the respective rug support assembly between a lowered loading position and a raised display position;

each rug support assembly including a front plate member in front of the post and a plurality of rack members each arranged to receive a respective rug, the rack members being mounted on the plate member for pivotal movement each about a respective vertical axis with the rack members arranged side by side across the plate member.

This arrangement allows the support of a larger number of rugs on a rack which is of simple and economic construction.

According to a third aspect of the invention there is provided a display rack for displaying a plurality of rugs comprising;

a plurality of generally upright elongate support posts;

a mounting assembly supporting the support posts arranged side by side in spaced parallel relationship;

each support post having mounted thereon for sliding movement therealong a respective one of a plurality of rug support assemblies;

each support post having a drive system for driving sliding movement of the respective rug support assembly between a lowered loading position and a raised display position;

each rug support assembly including at least one rug support arm thereon arranged to receive a respective rug, the arms being mounted for pivotal movement about a vertical axis with the arms arranged side by side;

and a plurality of divider posts each arranged between a support post and the next and arranged to extend generally upright at a position in front of the support posts so as to a engage rug support arms of a rug support assembly to prevent side to side movement of the arm of one support assembly sufficient to cause interference with the arm of a next adjacent assembly.

This prevents interference between the racks of one support and those of another which would otherwise detract from the efficient operation.

BRIEF DESCRIPTION OF THE DRAWINGS

One embodiment of the invention will now be described in conjunction with the accompanying drawings which.

In the drawings like characters of reference indicate corresponding parts in the different figures.

DETAILED DESCRIPTION

Referring to the accompanying drawings, there is illustrated a display rack 1 for displaying rugs 3. The display rack provides an aesthetically pleasing mechanism for displaying rugs as well as being safe and easy to use. The rack supports rugs such that the rugs are separated and can be viewed by a potential customer easily and can also be easily removed and replaced for convenience. The rack can be raised and lowered such that the rugs do not take up floor space and so that the rugs can be accessible by a user, respectively.

Figure 1:
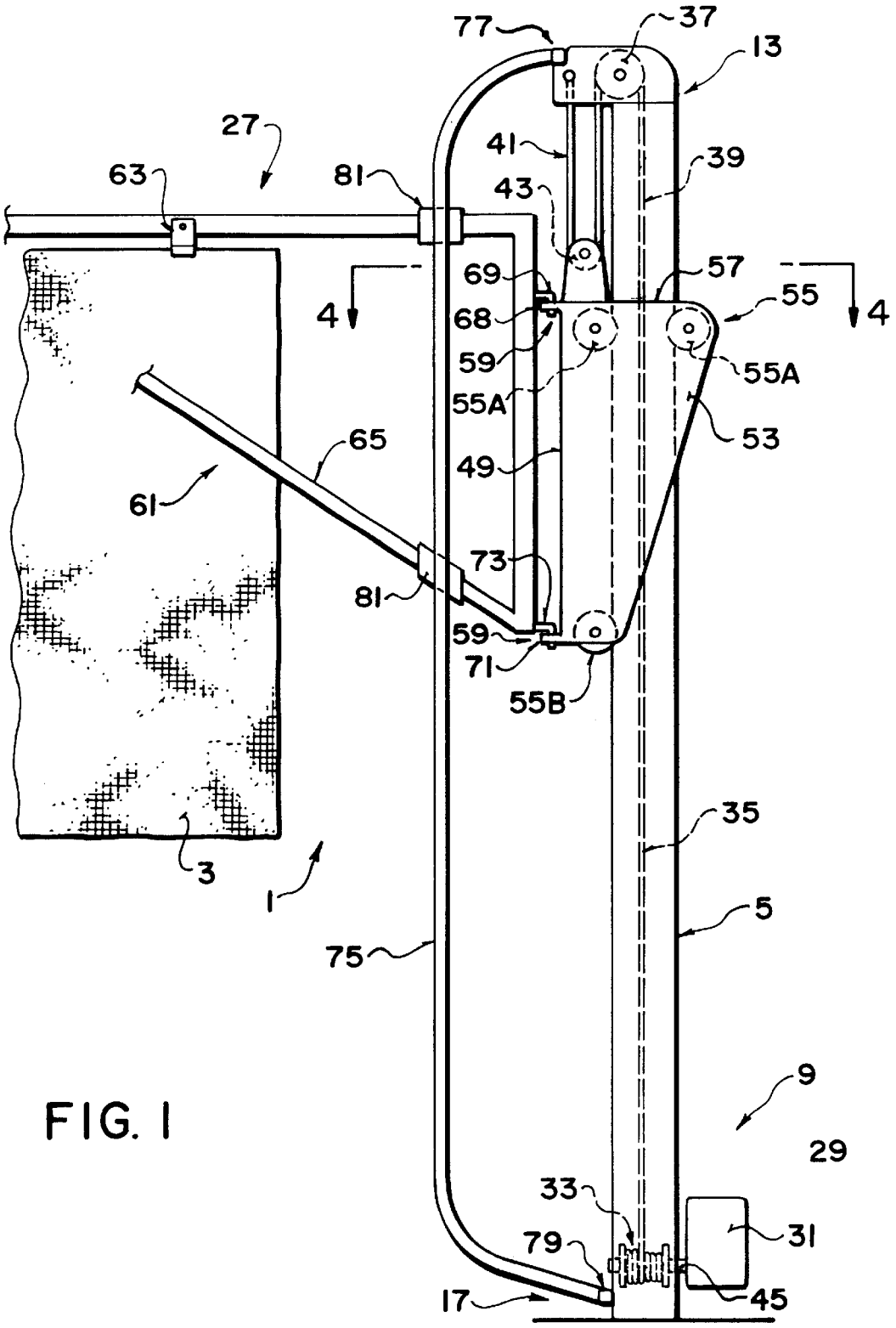
FIG. 1 is a side elevational view of the present invention.
Figure 2:
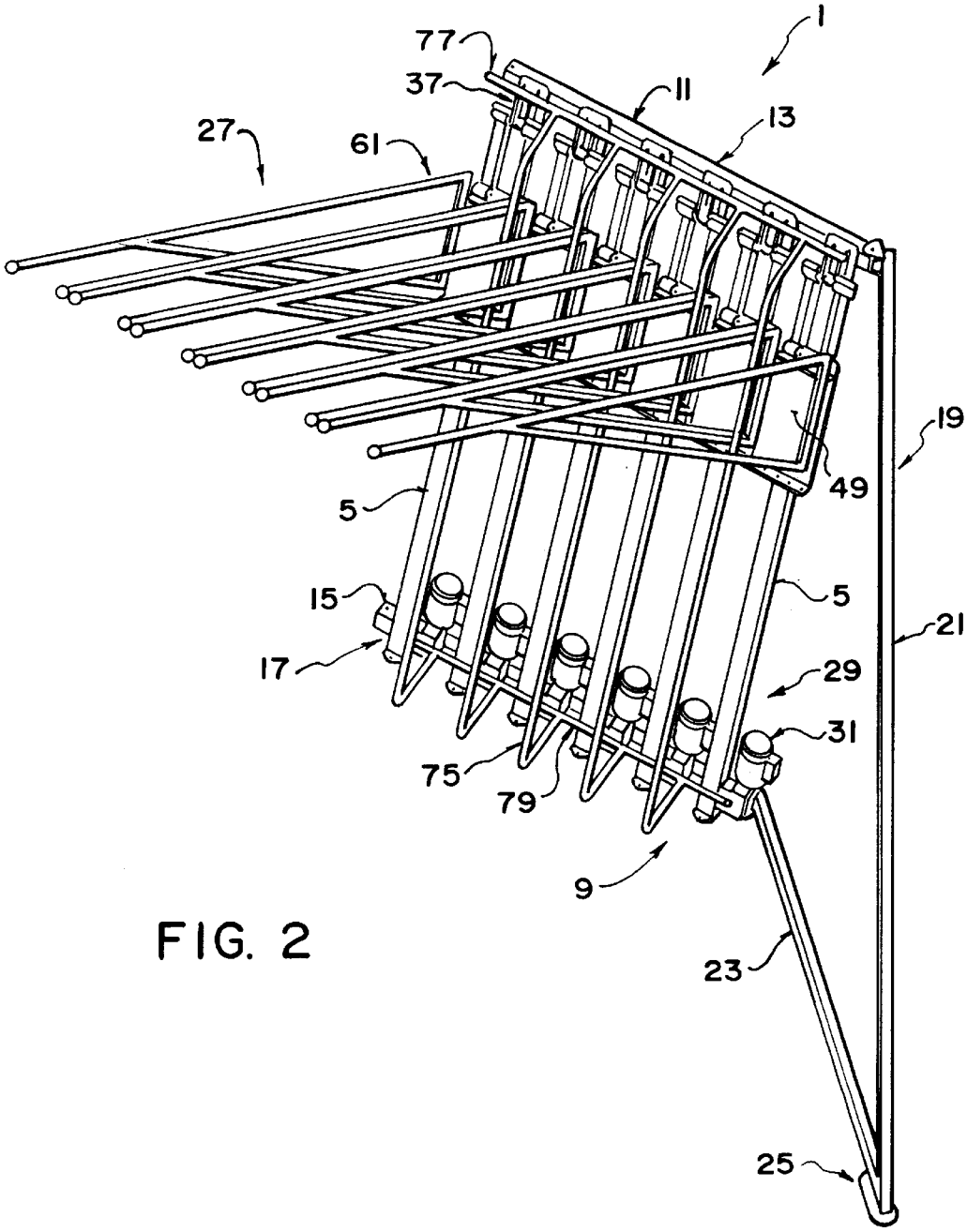
FIG. 2 is an isometric view of the present invention.
Figure 3:
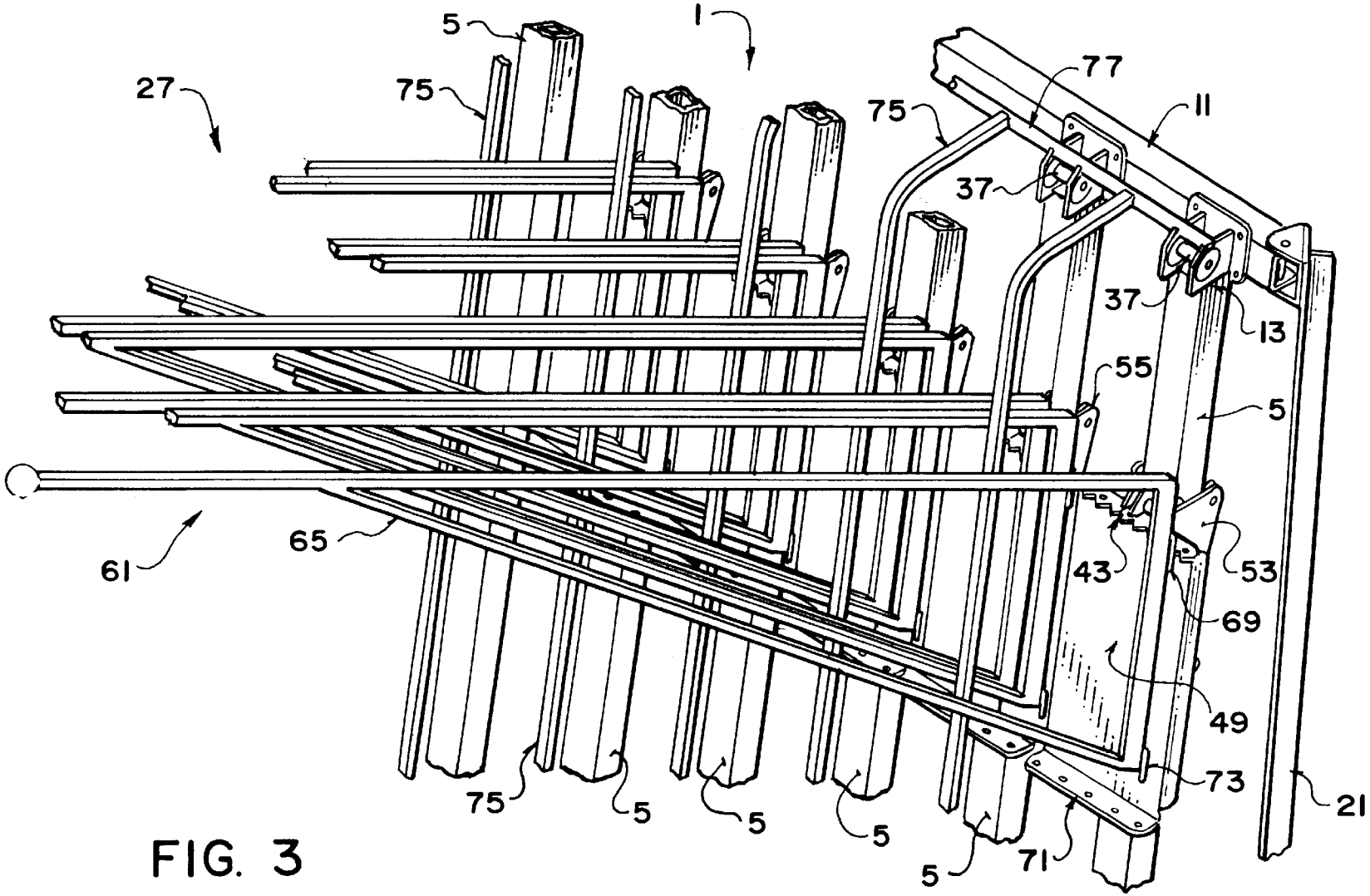
FIG. 3 is a partial isometric view of the present invention.
Figure 4:
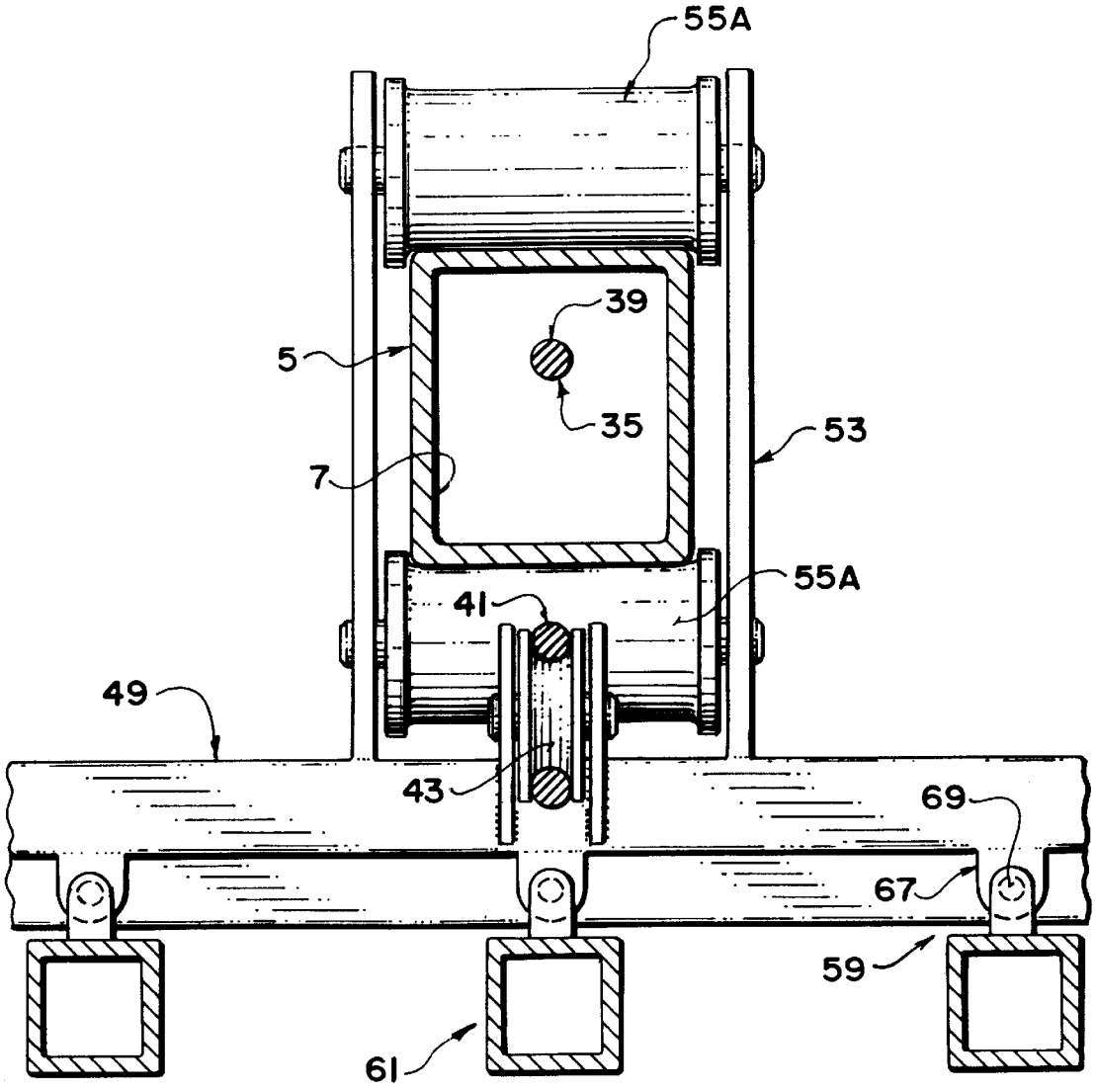
FIG. 4 is a horizontal cross section along the lines 4-4 of FIG. 1.
Figure 5:
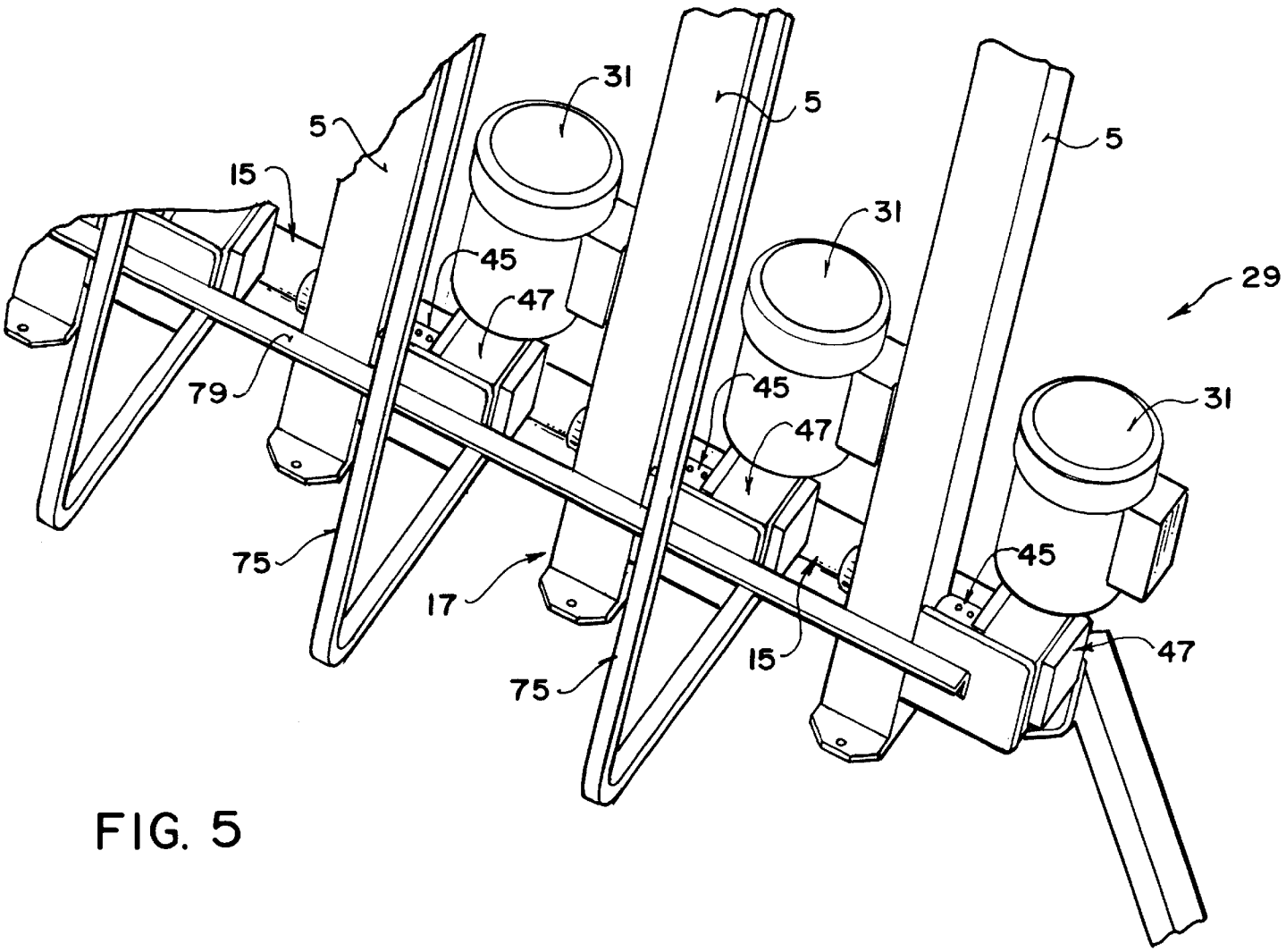
FIG. 5 is an isometric view of a part of the drive system of the present invention.
Figure 6:
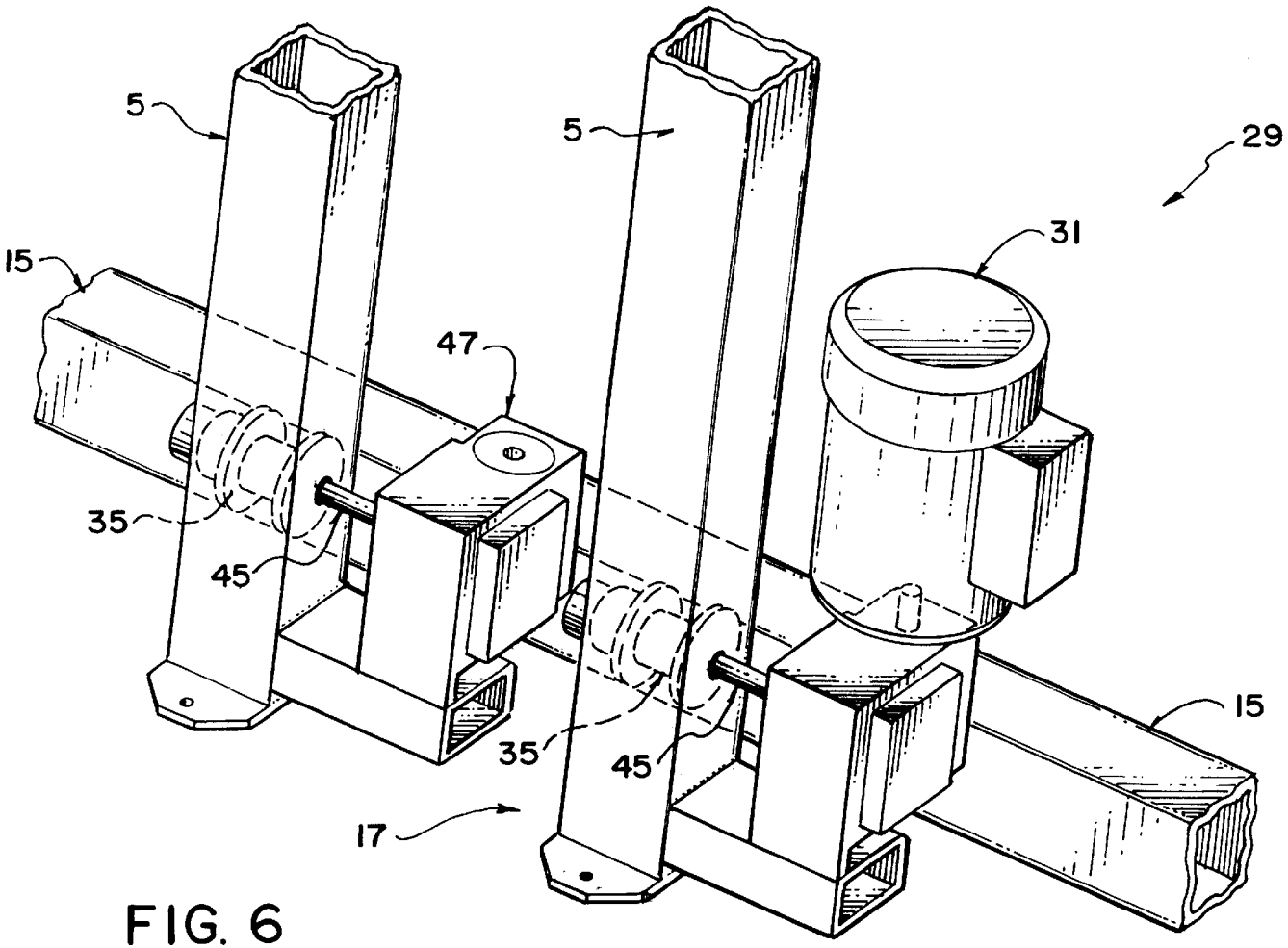
FIG. 6 is an isometric view of a part of the drive system of the present invention.
Figure 7:
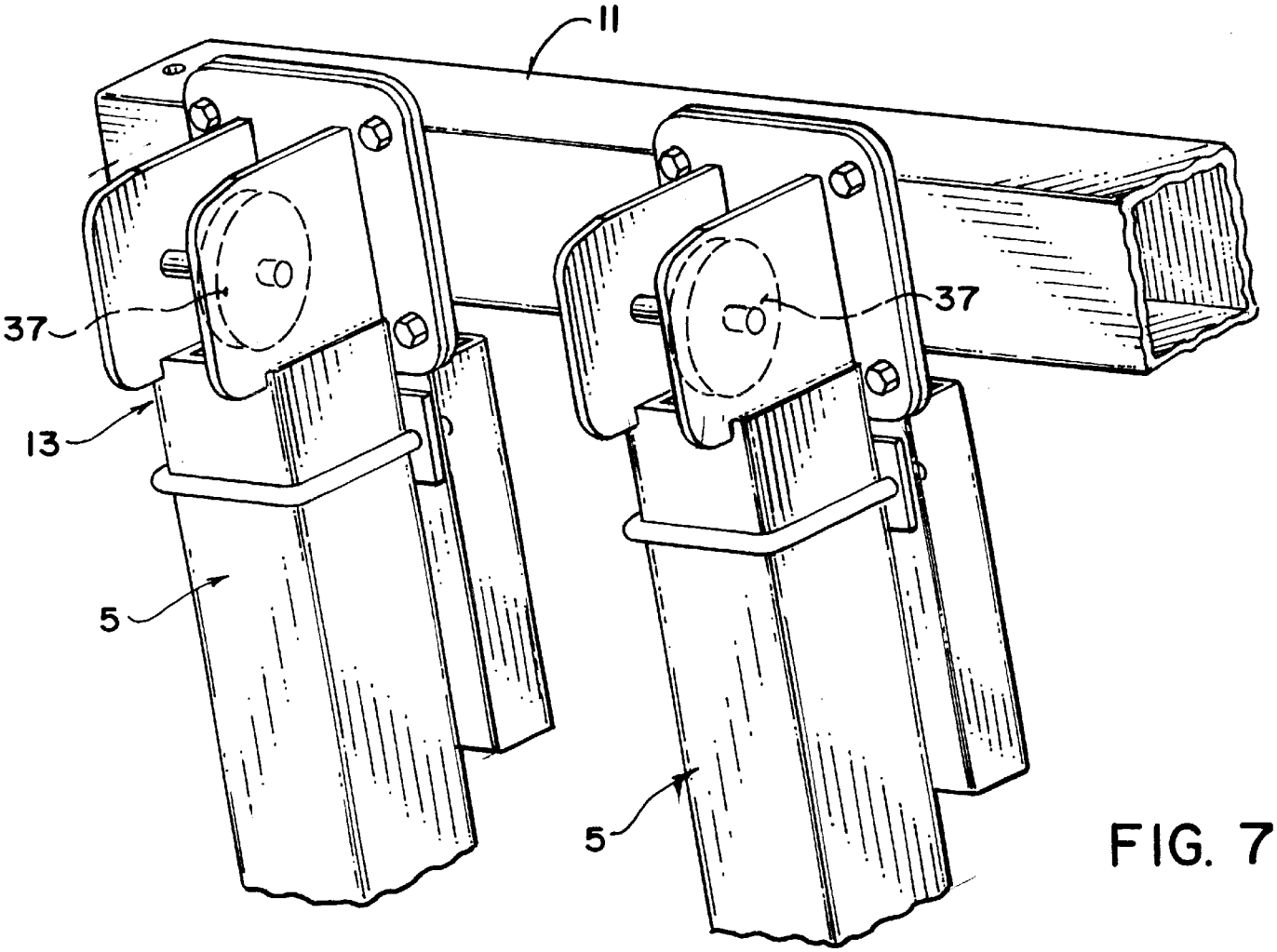
FIG. 7 is an isometric view of a part of the drive system of the present invention.

The rack has a plurality of generally upright elongate posts 5. The posts have a hollow interior 7 and are positioned vertically side by side in a spaced parallel relationship, as best shown in FIG. 2. The posts are supported by a mounting assembly 9. The mounting assembly has a cross bar 11 which connect top ends 13 of the posts and a bottom cross bar 15 which connects bottom ends 17 of the posts. The posts are positioned on the cross bars such that the posts are parallel and are secured in a spaced relationship to the next. Coupled to the end of each cross bar is a levelling assembly 19. The levelling assembly is arranged to support the rack such that the posts are at a 90 degree angle relative to the ground surface. The rack can be mounted on horizontal beams, found in many large warehouses, which may eliminate the need for the levelling assembly. The levelling assembly as a top post 21 which is pivotally mounted to each end of the top cross bar and extends downwards and outwards therefrom. A bottom post 23 is pivotally mounted to and extends from each end of the bottom cross bar and is coupled at its end to an end of the top post, on respective sides of the rack. A foot 25 is located at the junction of the posts for engaging the ground. The levelling posts are pivoted such that the rack is level.

Each support post has a rug support assembly 27 which is slidably mounted thereon such that the rug support assembly can be slid upwards and downwards on a post. The rug support assembly is arranged to support a plurality of rugs, as described later in detail.

A drive system 29 for driving sliding movement of the respective rug support assembly between a lowered loading position and a raised display position. An individual drive system is associated with one support post thereby driving the rug support assembly on each respective post. The drive assembly has a motor 31 which is mounted adjacent a respective post on the bottom cross bar. The motor is permanently mounted on the cross bar. The motor is arranged to drive a winch 33 located within a bottom end of the post in the hollow interior. The winch is arranged to rotate about a horizontal axis within the post for winding a cable 35. The cable extends upwards within the hollow interior of the post and is wrapped over a pulley 37 mounted at a furthermost top end of the post. The pulley bridges between a run 39 inside the post and a run 41 outside and in front of the post and extends to the support assembly. The winch is driven by the motor and a manually operable switch is used for operating the motor. The cable is wrapped around a second pulley 43 on the support assembly and extends upwards therefrom and is solidly fastened to a top end of the post adjacent the first pulley. The motor has a drive shaft 45 parallel to the post and includes a right angle drive 47 inside the housing for driving the winch within the post.

The rug support assemblies include a front plate member 49 in front of the post and a plurality of rack members 51 each arranged to received a respective rug. The rack members are mounted on the plate member for pivotal movement each about a respective vertical axis with the rack members arranged side by side across the plate member. The plate member includes a rearwardly extending bracket 53 carrying front and rear guide rollers 55 for rolling along on a front and rear respectively of the post. The second pulley is mounted to a top side 57 of the plate member in front of the post.

The bracket extends rearwards from the plate member on respective sides of the post. A pair of rollers 55A are rotatably mounted to the bracket at a top end thereon and are arranged to engage respective first and rear sides of the post. A bottom roller 55B is rotatably mounted to a bottom end of the bracket below the first rollers and is arranged to engage the front side of the post. The bottom roller supports the rug supports at a right angle relative to the post.

Pivot mounts 59 at a top and bottom front side of the plate member is arranged to support a plurality of arm assemblies 61 which extend forwards from the plate whereon the rugs are placed. The arms are pivotally mounted at the top end and a bottom end to the plate member such that the arms can be rotated about a vertical axis. The arms are spaced on the plate and are parallel. The rugs are fastened to the arm by rug clips 63. A brace 65 is arranged to provide support to the arm. The pivot mount support a top end 67 of a hinge 69 and has a shelf 71 at a bottom end for receiving and supporting a bottom end 73 of the hinge. The hinges are spaced along the plate such that the arms have horizontal movement allowing a user to manipulate each rug for viewing.

Each plate member can support a plurality of arms, a divider post 75 is located between a support post and the next. The divider is arranged to extend generally upright at a position in front of the support posts so as to engage an arm of a respective support assembly to prevent side to side movement of the arm of one support assembly sufficient to cause interference with the arm of a next adjacent assembly. The divider extends from a top rail 77 at a top end of the post downwards to a bottom rail 79, each of the rails interconnecting the support posts. The divider posts is secured to each rail for preventing said movement of the arms in any raised or lowered position. The arms have bumpers 81 which are arranged to engage the dividers for protecting the arms from damage by contact.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A display rack for displaying a plurality of rugs comprising;

a plurality of generally upright elongate support posts;

a mounting assembly supporting the support posts arranged side by side in spaced parallel relationship;

each support post having mounted thereon for sliding movement therealong a respective one of a plurality of rug support assemblies;

each support post having a drive system for driving sliding movement of the respective rug support assembly between a lowered loading position and a raised display position;

each drive system including a pulley at an upper end of the support post and a cable wrapped over the pulley and arranged such that pulling of the cable acts to raise the support assembly on the post;

each drive system including a winch for pulling the cable;

and each drive system including a motor mounted permanently on the post or on the mounting assembly for the post for driving the winch and a manually operable switch for operating the motor.

2. The rack according to claim 1 wherein the cable runs inside a hollow tube defining the post and wherein the winch is mounted across the post.

3. The rack according to claim 2 wherein the motor is mounted on a housing at one side of the post.

4. The rack according to claim 3 wherein the motor has a drive shaft parallel to the post and includes a right angle drive inside the housing for driving the winch within the post.

5. The rack according to claim 1 wherein the pulley is mounted at a top of the post and bridges between a run inside the post and a run outside and in front of the post and extending to the support assembly.

6. The rack according to claim 1 wherein each rug support assembly includes a front plate member in front of the post and a plurality of rug support arms each arranged to receive a respective rug, the rug support arms being mounted on the plate member for pivotal movement each about a respective vertical axis with the rug support arms arranged side by side across the plate member.

7. The rack according to claim 1 wherein the plate member includes a rearwardly extending bracket carrying front and rear guide rollers for rolling along on a front and rear respectively of the post.

8. The rack according to claim 1 wherein there is provided a plurality of divider posts each arranged between a respective support post and the next and arranged to extend generally upright at a position in front of the support posts so as to engage rug support arms of the rug support assembly to prevent side to side movement of the rug support arms sufficient to cause interference therebetween.

9. The rack according to claim 8 wherein there is provided a top rail and a bottom rail interconnecting the posts and arranged to mount top and bottom ends respectively of each of the divider posts thereon.

10. The rack according to claim 9 wherein the divider posts each have top and bottom end portions extending rearwardly from the divider post to the respective rail.

11. A display rack for displaying a plurality of rugs comprising;

a plurality of generally upright elongate support posts;

a mounting assembly supporting the support posts arranged side by side in spaced parallel relationship;

each support post having mounted thereon for sliding movement therealong a respective one of a plurality of rug support assemblies;

each support post having a drive system for driving sliding movement of the respective rug support assembly between a lowered loading position and a raised display position;

each rug support assembly including a front plate member in front of the post and a plurality of rug support arms each arranged to receive a respective rug, the rug support arms being mounted on the plate member for pivotal movement each about a respective vertical axis with the rug support arms arranged side by side across the plate member;

wherein there is provided a plurality of divider posts, each divider post being arranged between a respective support post and the next support post and arranged to extend generally upright at a position in front of the support posts so as to engage the rug support arms of the rug support assemblies to prevent side to side movement of the rug support arms of one support assembly sufficient to cause interference with the rug support arms of a next adjacent support assembly.

12. The rack according to claim 11 wherein the plate member includes a rearwardly extending bracket carrying front and rear guide rollers for rolling along on a front and rear respectively of the post.

13. The rack according to claim 11 wherein there is provided a top rail and a bottom rail interconnecting the posts and arranged to mount top and bottom ends respectively of each of the divider posts thereon.

14. The rack according to claim 13 wherein the divider posts each have top and bottom end portions extending rearwardly from the post to the respective rail.

15. A display rack for displaying a plurality of rugs comprising;

a plurality of generally upright elongate support posts;

a mounting assembly supporting the support posts arranged side by side in spaced parallel relationship;

each support post having mounted thereon for sliding movement therealong a respective one of a plurality of rug support assemblies;

each support post having a drive system for driving sliding movement of the respective rug support assembly between a lowered loading position and a raised display position;

each rug support assembly including at least one rug support arm thereon arranged to receive a respective rug, said at least one rug support arm being mounted for pivotal movement about a vertical axis with the rug support arms arranged side by side;

and a plurality of divider posts each arranged between a support post and the next and arranged to extend generally upright at a position in front of the support posts so as to engage the rug support arms of the rug support assemblies to prevent side to side movement of the rug support arm of one support assembly sufficient to cause interference with the rug support arm of a next adjacent assembly.

16. The rack according to claim 15 wherein there is provided a top rail and a bottom rail interconnecting the support posts and arranged to mount top and bottom ends respectively of each of the divider posts thereon.

17. The rack according to claim 16 wherein the divider posts each have top and bottom end portions extending rearwardly from the divider post to the respective rail.

* * * * *